United States Patent [19]

Comstock et al.

[11] 4,172,691

[45] Oct. 30, 1979

[54] SHEET METAL FAN ASSEMBLY

[75] Inventors: Everad A. Comstock; Charles L. Smithson, Jr., both of Indianapolis, Ind.

[73] Assignee: Wallace Murray Corporation, New York, N.Y.

[21] Appl. No.: 825,133

[22] Filed: Aug. 16, 1977

Related U.S. Application Data

[63] Continuation-in-part of Ser. No. 624,386, Oct. 21, 1975, abandoned.

[51] Int. Cl.[2] ..... F04D 29/38

[52] U.S. Cl. ..... 416/132 A; 416/242; 416/DIG. 3

[58] Field of Search ..... 416/132 A, DIG. 3, 210 R, 416/242, 243

[56] References Cited

U.S. PATENT DOCUMENTS

| | | | |
|---|---|---|---|
| 1,041,913 | 10/1912 | Tyson | 416/DIG. 3 |
| 1,313,598 | 8/1919 | Ingells | 416/DIG. 3 |
| 1,634,554 | 7/1927 | Pajalic | 416/DIG. 3 |
| 1,868,528 | 7/1932 | Gardner | 416/DIG. 3 |
| 2,035,479 | 3/1936 | Hueglin | 416/DIG. 3 |
| 2,201,153 | 5/1940 | Brown | 416/DIG. 3 |
| 3,315,750 | 4/1967 | Delaney | 416/DIG. 3 |
| 3,416,725 | 12/1968 | Bohanon | 416/228 |

FOREIGN PATENT DOCUMENTS

| | | | |
|---|---|---|---|
| 417232 | 10/1934 | United Kingdom | 416/132 A |

*Primary Examiner*—Everette A. Powell, Jr.

*Attorney, Agent, or Firm*—Thomas J. Greer, Jr.

[57] ABSTRACT

A sheet metal fan exhibiting special utility as a radiator fan for an internal combustion engine. A spider carries the blades on its arms, the arms each having a radially extending stiffening rib in opposed relation to a complementary rib in its blade to thereby form a tube where the stiffening ribs are radially coextensive. The stiffening rib on each blade intersects a continuous, blade stiffening channel.

8 Claims, 6 Drawing Figures

SHEET METAL FAN ASSEMBLY

Cross Reference to Related Application

This application is a divisional continuation-in-part of copending application Ser. No. 624,386, filed Oct. 21, 1975 now abandoned.

This invention relates to a sheet metal fan assembly of the type particularly adapted for use with the cooling system of an internal combustion engine mounted in an automotive vehicle. A typical example of the utility of the fan assembly of this invention is between the radiator and the engine of an automotive vehicle. The fan draws air from ambience through the radiator thereby to assist in cooling the liquid which has transferred heat from the interior of the engine to the radiator. Such fans are well known, exist in a wide variety of forms and have enjoyed the attention of numerous workers in this art.

One common form of such a fan construction is defined by a sheet metal hub or spider having arms projecting radially outwardly. Each arm carries an associated blade which may be attached as by welding, riveting, or the like. Either the blade or the attaching arm or both may be twisted so as to vary the pitch of the fan. The spider hub is attached to a pulley or other rotary member which is powered by the engine. Examples of such prior art sheet metal fan constructions are given by the following patents: U.S. Pat. No. 295,449, issued to Smith; U.S. Pat. No. 1,041,913, issued to Tyson; U.S. Pat. No. 1,117,103, issued to Steinbach; U.S. Pat. No. 1,255,346, issued to Sparks; U.S. Pat. No. 1,404,298, issued to Jacobs; U.S. Pat. No. 1,597,175, issued to Boening; U.S. Pat. No. 1,868,528, issued to Gardner; U.S. Pat. No. 2,681,708, issued to Mix; U.S. Pat. No. 2,906,349, issued to Hans; U.S. Pat. No. 3,147,811, issued to Klonoski; U.S. Pat. No. 3,147,958, issued to Stiffler; U.S. Pat. No. 3,827,482, issued to Pope; British Pat. No. 417,232; German Pat. No. 762,625; and British Pat. No. 908,586. It will be understood that these patents do not necessarily define all of the prior art.

According to the practice of this invention, a fan assembly is constructed wherein each blade is bent outwardly from the plane of rotation of the fan assembly so as to assist in outward radial flow. Such radial outward flow reduces the exhaust space required directly behind the fan. The fan assembly of this invention employs reinforcing rib elements in relatively thin steel blades. The ribs add strength to the blade and thereby permit metal of lesser thickness and weight. Further according to the practice of this invention, blade failure is inhibited. Such typical blade failure occurs due to first mode resonance of each of the spider arms and is reduced by novel reinforcing rib construction of each fan blade. Each spider arm also carries a rib on its outer portion which registers with a complementary rib carried on the innermost radial portion of each fan blade. Further in accordance with the practice of this invention, a novel connection between the blade and its associated arm is made wherein the spot connections, which may be in the form of rivets, spot welds, or the like, are configured in a particular manner with respect to the reinforcing ribs on the fan blade.

In the drawings:

FIG. 5 is a section taken along section line 5—5 of FIG. 3.

FIG. 6 is a radial section taken along section line 6—6 of FIG. 3.

Figure 1:
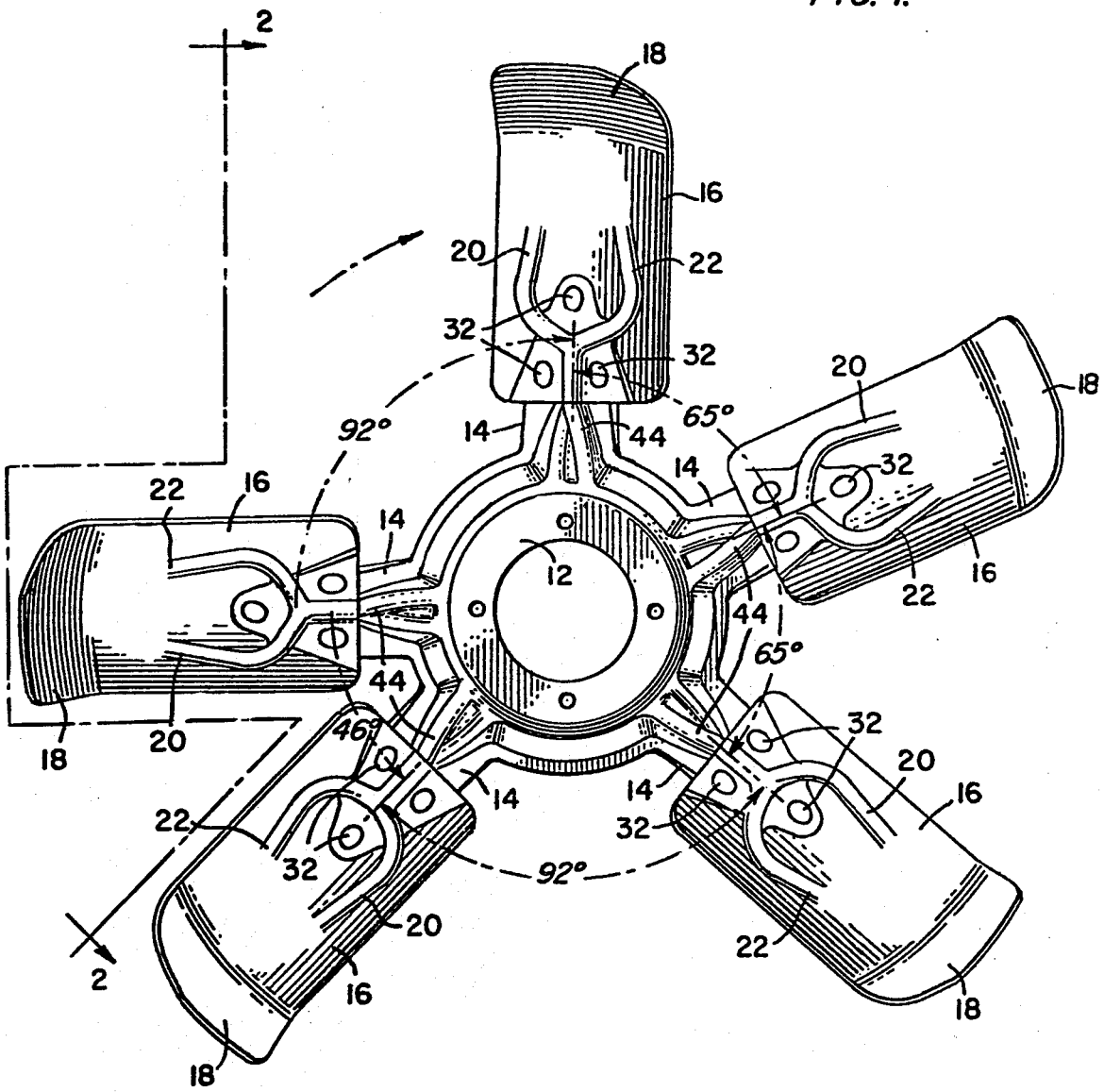
FIG. 1 is a plan view of a typical sheet metal fan blade construction according to the practice of this invention.

Referring now to the drawings, the numeral 10 denotes generally the sheet metal fan assembly of this invention and is defined by a sheet metal hub 12 having a plurality of angularly spaced arms 14. The hub 12 is sometimes referred to as a spider and the arms as spider arms. The numeral 16 denotes a typical fan blade according to this construction, the radially outermost portion 18 of the blade being curved away from the remainder of the blade. Each blade is in the general form of a part-cylinder surface, with the bent portion 18 extending along the entire width of the blade and away from the general plane of the blade. The numeral 20 denotes one leg of a reinforcing channel (rib) while the numeral 22 denotes a similar channel. The two channels 20 and 22 are of generally U-shape and merge with each other and with the radial rib 30 in the channel portion 24, forming a branched rib configuration of generally Y-shape. The rib 30 extends from the radially innermost portion of each blade 16 and intersects the radially innermost portion of the closed loop. Both the reinforcing channel 20, 22, 24 and the reinforcing rib 30 bulge outwardly from the forward side of the blade, both the reinforcing rib 30 and the reinforcing channel being of the same depth.

The numeral 32 denotes rivets employed to fasten each blade 16 to its associated spider arm 14. One of the rivits is inside of the branched reinforcing channel, while the other two are outside of it, one lying on one side of the reinforcing rib 30 and the other on the other side of the reinforcing rib 30.

The spider or hub 12 is provided with a side wall 40 joining the inner portion 41 with the marginal flange 46. As will be seen from FIGS. 3 and 4, each arm 14 presents a forwardly facing mounting pad surface 45 which is displaced radially outwardly from the hub 12 and is of generally triangular shape. This mounting pad surface is flat and is twisted from the plane of the marginal flange 46 but merges smoothly therewith as indicated at 46'. The inner end of each blade similarly is provided with a flat, generally triangular area 47 whose rear face is securely affixed against the mounting pad surface 45.

Figure 2:
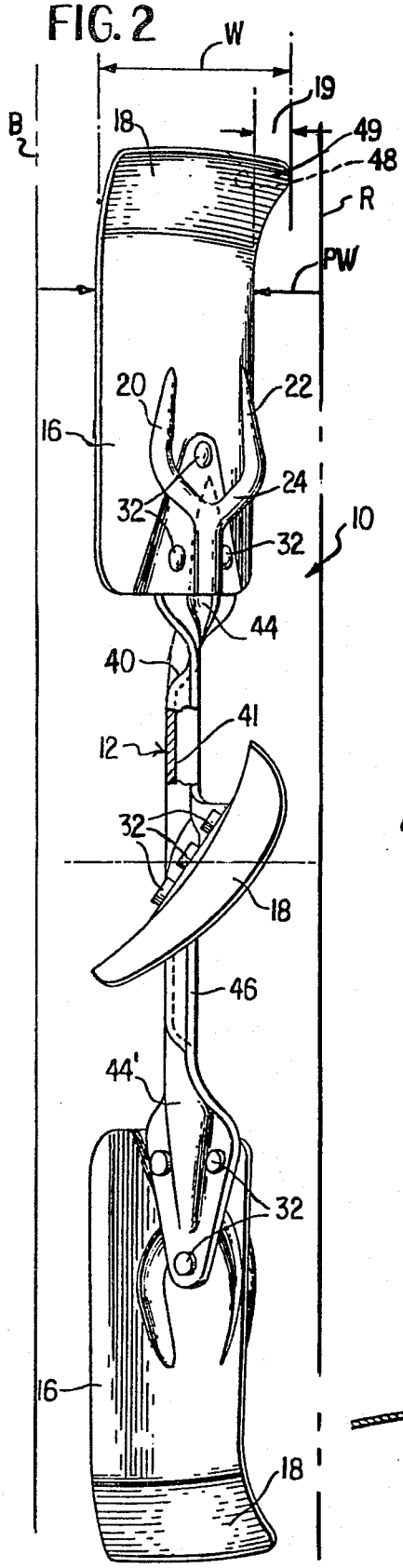
FIG. 2 is a view taken along section 2—2 of FIG. 1.
Figure 3:
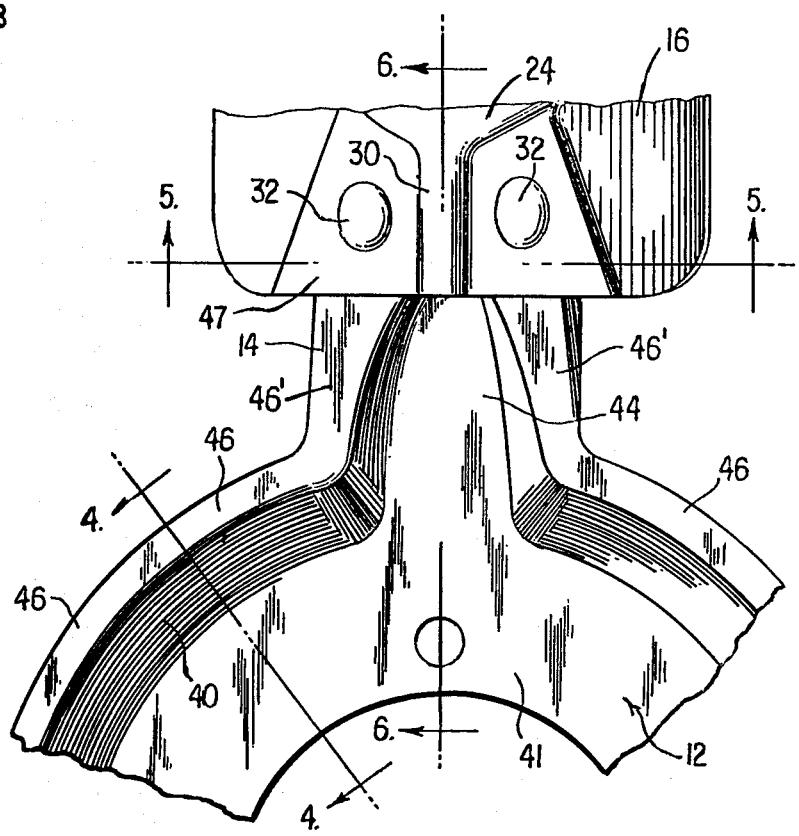
FIG. 3 is an enlarged view of a typical fan blade and spider arm of FIG. 1.
Figure 3:
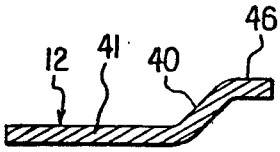
Figure 4:
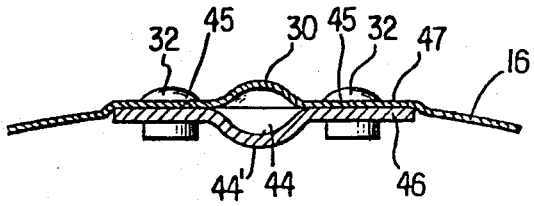
FIG. 4 is a section taken along section line 4—4 of FIG. 3.
Figure 4:
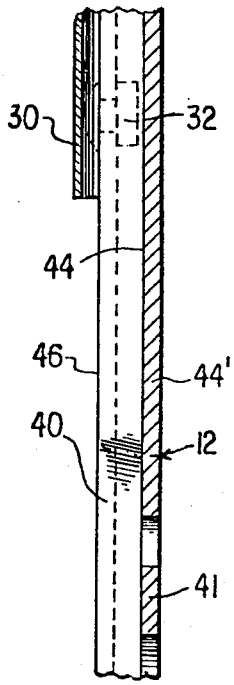

Each arm 14 is provided with a channel or trough 44 which interrupts the wall 40 as shown in FIG. 3 and thereby merges smoothly with the forward surface of the inner portion 41 of the hub, extending radially therefrom into the mounting pad surface 45 to terminate short of the area of the outermost rivet, as shown in broken lines in FIG. 2. The trough or channel 44 bulges rearwardly from the arm 14 and defines the radially extending reinforcing rib 44'. The two ribs 44' and 30 are registered to form a tube-like reinforcing structure as is illustrated in FIGS. 5 and 6.

The surface of the fan blade 16 in the region of the rivets 32 is flat, as is the surface of the arm 14, except for the reinforcing rib 30 and the reinforcing rib 44'. The radially outermost portion of the spider 12 terminates in a flange denoted by the numeral 46. As may be observed particularly from FIG. 2, the spider arms 14 are twisted relative to the plane of the spider hub 12 to define the pitch of the blades.

The reader will note that an imaginary line drawn from the outermost rivet 32 inside the reinforcing channel to either of the other two rivets intersects orthogonally the channel portion 24.

A typical sheet metal fan blade failure occurs under the action of the first mode of resonance of the spider arm. Bending will typically occur about the attachment points defined by rivets 32. In the present construction, bending of fan blade 16 (see FIG. 3) about an imaginary axis from the outer rivet 32 to either of the two inner rivets 32 will be at right angles to the reinforcing channel portion 23 and accordingly the blade 16 of this invention will be better able to resist failure because of this geometrical relationship. The reader will also observe that the rib 30 at the radially innermost portion of each fan blade 16 gives continuity and radial stiffness relative to the spider hub 12, the rib 44' and the rib 30 opposing each other to yield such continuity. It will be observed particularly from FIG. 2 of the drawings that the hub 12 is in the general form of a dish. This results in a forward offset and permits center piercing or rearward offset of the blade with a minimal dimension required between the mounting surface and the rear of the assembly. A typical fan blade assembly fashioned in accordance with this invention employs a reinforcing channel 20, 22, 24 and reinforcing rib 30 of approximately 0.30 inch width and approximately 0.30 inches deep. Typical prior art reinforcing channels or ribs have employed depths of the order of 0.120 inches. In the present invention, this relatively high ratio between the depth of the channels or ribs and their width permits the use of thinner metal for the fan blades.

Another advantage displayed by this construction is the greater radial air flow caused by the tip of each blade being bent towards the suction side of the fan assembly, i.e., towards the radiator. As noted, greater radial air flow improves the cooling effectiveness of a fan assembly.

In FIG. 2, the bend of each tip is toward the right, the tips extending beyond the projected width of the fan assembly. The projected width of a fan assembly is its width as viewed at right angles to the axis of rotation of the fan assembly. The numeral 19 designates the extension of the blade tips beyond the projected width of the remainder of the fan, the latter denoted as PW. The fan blade tips thus define the widest part of the projected width of the fan assembly.

The rear face of the inner portion 41 of the hub serves to mount the fan assembly to a member (not shown) driven by the engine. Often, the space T between the radiator and the engine block, represented, respectively, by the lines R and B in FIG. 2, is quite restricted and the space allotted for the fan assembly correspondingly has little depth. Because the engine block is close to and immediately behind the fan blades, the air exhausted by the fan tends to impinge directly upon the engine block. This not only restricts the flow of air but also causes the fan to consume needless power. Consequently, fan blades of this type utilize forwardly bent tip portions in order to induce a radial, outward discharge flow of air and thus decrease the mass flow of air impinging against the engine block. In customary practice, the forwardly bent fan blade tips are cut away generally along a line such as that indicated at 48 in FIG. 2 and the twist of the blade is adjusted so that the projected width of the blade is equal to the distance PW.

However, by allowing the bent tip to protrude forward (toward the radiator) as shown in FIG. 2, such that the projected width at the tip is given by the distance "W," a lower consumption of fan power results while still obtaining the requisite flow of air through the radiator.

What is claimed is:

1. A sheet metal fan assembly comprising, in combination:

a sheet metal hub comprising a central portion and a plurality of arms integral with and projecting radially from said central portion, each arm presenting a forwardly facing mounting pad surface spaced outwardly from said central portion and said central portion having a marginal flange having a forwardly facing surface merging with said mounting pad surface, each mounting pad surface being twisted out of the plane of said marginal flange;

a sheet metal fan blade for each arm, each fan blade having an inner end portion overlapping a corresponding mounting pad surface and being securely fixed thereagainst, whereby each fan blade likewise is twisted out of the plane of said marginal flange, and each fan blade including an outer end projecting radially outwardly beyond its corresponding mounting pad surface and terminating in a forwardly bent tip portion;

said central portion of the hub including an inner portion offset rearwardly from but parallel to said marginal flange and presenting a mounting surface on its rear face for connection to an engine-driven drive member and a side wall joining said inner portion with said marginal flange, and each arm having a radially extending trough therein interrupting said side wall and merging smoothly with said inner portion of the hub and extending radially outwardly into the area of said mounting pad surface, said trough defining a reinforcing rib bulging outwardly from the rearward side of its arm; and each blade having a radially extending trough therein extending outwardly from the inner end of the blade in registry with the reinforcing rib of its corresponding arm, said trough in the blade defining a reinforcing rib bulging outwardly from the forward side of the blade.

2. A sheet metal fan assembly as defined in claim 1 wherein said mounting pad surface is flat and of generally triangular configuration, each blade also having a mating generally triangular flat area on its inner end portion.

3. A sheet metal fan assembly as defined in claim 2 wherein each fan blade is of generally rectangular plan view, the amount by which each blade is twisted out of the plane of said marginal flange of the hub and the amount of forward bending of the tip of each blade being such that the width of the blade as projected onto a plane normal to the plane of said marginal flange of the hub is widest at said fowardly bent tip of each blade.

4. A sheet metal fan assembly as defined in claim 1 wherein each blade is provided with a generally U-shaped trough forming generally Y-shape with its radial trough and defining reinforcing rib arms bulging forwardly from the fan blade and branching from the radial rib to merge into the fan blade body radially beyond said mounting pad portion of its corresponding arm.

5. A sheet metal fan assembly comprising, in combination:

a sheet metal hub comprising a central portion and a plurality of arms integral with and projecting radially from said central portion, each arm presenting a forwardly facing mounting pad surface spaced radially outwardly from said central portion and said central portion having a marginal flange having a forwardly facing surface merging with said mounting pad surface, each mounting pad surface being twisted out of the plane of said marginal flange;

a sheet metal fan blade for each arm, each fan blade having an inner end portion overlapping a corresponding mounting pad surface and being securely fixed thereagainst, whereby each fan blade likewise is twisted out of the plane of said marginal flange, and each fan blade including an outer end projecting radially outwardly beyond its corresponding mounting pad surface and terminating in a forwardly bent tip portion;

said central portion of the hub including an inner portion offset rearwardly from but parallel to said marginal flange and presenting a mounting surface on its rear face for connection to an engine-driven drive member and a side wall joining said inner portion with said marginal flange, and each arm having a radially extending through therein interrupting said side wall and merging smoothly with said inner portion of the hub and extending radially outwardly into the area of said mounting pad surface, said trough defining a reinforcing rib bulging outwardly from the rearward side of its arm;

each blade having a radially extending trough therein extending outwardly from the inner end of the blade in registry with the reinforcing rib of its corresponding arm, said trough in the blade defining a reinforcing rib bulging outwardly from the forward side of the blade, the tip of each blade being curved away from the remainder of the blade, thereby to induce radially outward flow of air, the tips defining the widest part of the projected width of the fan assembly.

6. A sheet metal fan assembly as defined in claim 5 wherein said mounting pad surface is flat and of generally triangular configuration, each blade also having a mating generally triangular flat area on its inner end portion.

7. A sheet metal fan assembly as defined in claim 6 wherein each fan blade is of generally rectangular plan view, the amount by which each blade is twisted out of the plane of said marginal flange of the hub and the amount of forward bending of the tip of each blade being such that the width of the blade as projected onto a plane normal to the plane of said marginal flange of the hub is widest at said forwardly bent tip of each blade.

8. A sheet metal fan assembly as defined in claim 5 wherein each blade is provided with a generally U-shaped trough forming generally Y-shape with its radial trough and defining reinforcing rib arms bulging forwardly from the fan blade and branching from the radial rib to merge into the fan blade body radially beyond said mounting pad portion of its corresponding arm.

* * * * *